United States Patent [19]

Yoshino et al.

[11] Patent Number: 4,730,287

[45] Date of Patent: Mar. 8, 1988

[54] POWER SUPPLY FOR ELECTRONIC TIMPIECE

[75] Inventors: Masahito Yoshino; Yoshitsugu Nishiwaki, both of Suwa, Japan

[73] Assignee: Seiko Epson Corporation, Tokyo, Japan

[21] Appl. No.: 849,932

[22] Filed: Apr. 9, 1986

Related U.S. Application Data

[63] Continuation-in-part of Ser. No. 716,891, Mar. 28, 1985, abandoned.

[30] Foreign Application Priority Data

Apr. 10, 1985 [JP] Japan ..... 60-76007

[51] Int. Cl.[4] ..... G04C 3/00

[52] U.S. Cl. ..... 368/205

[58] Field of Search ..... 368/205; 323/906; 320/1, 2; 363/59, 60; 307/110

[56] References Cited

U.S. PATENT DOCUMENTS

| | | | |
|---|---|---|---|
| 4,134,057 | 1/1979 | Portmann | 320/61 |
| 4,404,624 | 9/1983 | Yamazaki | 363/59 |
| 4,451,743 | 5/1984 | Suzuki et al. | 307/110 |
| 4,634,953 | 1/1987 | Shoji et al. | 368/205 |
| 4,653,931 | 3/1987 | Takeda | 368/205 |

*Primary Examiner*—Bernard Roskoski
*Attorney, Agent, or Firm*—Blum Kaplan

[57] ABSTRACT

To increase the utilization by an electric timepiece, such as a quartz watch, of the electric energy derived from a primary source, such as a photo cell, which energy is stored in a multi-layer capacitor, the voltage on the capacitor is fed to transfer capacitors which are connected in series or in parallel to be charged from the multi-layer capacitor and then connected in series or in parallel to charge an auxiliary capacitor which drives the movement of the timepiece. Provisions are made for starting the watch when the stored voltage is less than the operating voltage of the watch movement.

38 Claims, 18 Drawing Figures

POWER SUPPLY FOR ELECTRONIC TIMPIECE

BACKGROUND OF THE INVENTION

This is a continuation-in-part of application Ser. No. 716,891, filed Mar. 28, 1985 now abandoned.

The present invention relates to power supplies for electronic timepieces such as a quartz crystal watches and the like. More particularly, the invention relates to improvements in such power supplies in which the primary source of energy has a discharge characteristic which is not flat but which changes with continued use of the energy.

In general, in timepieces which use electric energy as a power source, such as quartz crystal watches, the energy of the power source is most fully utilized when the power source has a flat discharge characteristic such as that provided by a silver battery. However, such systems have disadvantages in that, for example, the silver battery is expensive and has a limited life.

To provide good battery life, other primary power sources have been proposed, such as the alkali-manganese battery or the combination of a solar battery as a primary power source which charges a secondary power source such as a high-capacity storage capacitor. These solutions, however, have their own disadvantages. The alkali-manganese battery does not have a flat discharge characteristic, with the result that, even after the watch has stopped, a significant quantity of energy remains unutilized in the battery. Further, when a high-capacity capacitor is used as a secondary power source, the time of operation until the watch stops is limited by the discharge characteristic of the capacitor and thus this method is not suitable for practical use.

SUMMARY OF THE INVENTION

According to the present invention, an electronic timepiece is furnished with a power supply which includes at least a primary power source and a secondary power source which holds less electric energy than the primary source and which can be charged from the primary source. Transfer means are provided in a supply circuit for supplying electric energy from the secondary power source to the motor which drives the timepiece. To this end, the transferred energy may be stored in an auxiliary power source. The transfer means includes means for transforming the voltage level from that of the secondary power source to another level for supply to the motor.

In a preferred embodiment, the secondary power source comprises a capacitor which can be charged, for example, by a photoelectric cell. When the primary source is a photoelectric cell, the secondary power source is charged whenever the voltage of the photoelectric cell is raised above that of the secondary power source by illumination. The voltage level present in the secondary power source is measured in a detector and is either coupled straight through the supply circuit to the drive motor of the timepiece and any auxiliary power source when the secondary power source is fully charged, or is boosted when a predetermined lower level is found to be present in the secondary power source, so that the voltage supplied to the motor is kept high enough to keep the watch running.

In one embodiment of the invention, several voltage levels are detected and, in response to appropriate control signals, two capacitors, which serve as charge transfer devices, are connected either in series or in parallel with each other for charging from the secondary power source. After charging, the capacitors are connected in parallel or in series with each other and the auxiliary power source to transfer charge at a boosted voltage level to the auxiliary power source.

In a further embodiment, for use in starting a timepiece in which the primary source is a solar battery and the secondary power source is insufficiently charged, a dropping resistor is placed in series with the secondary source and the timepiece drive is connected in parallel with the series combination so formed. Then, when the solar battery is illuminated, the voltage which appears across the series combination as a result of the initial current surge is sufficient to start the time piece. When the voltage across the series combination reaches a level such that the voltage across the secondary power source is sufficient to operate the timepiece, a switching transistor, placed across the dropping resistor, is actuated so that the charging current can flow directly to the secondary power source.

In another embodiment, for use with a timepiece employing, for example, a quartz crystal oscillator, failure of oscillation is detected, and a logic circuit initiates boosting of the voltage being supplied to the watch movement.

Accordingly, it is an object of the present invention to provide an improved power supply structure for an electronic timepiece in which, even when the discharge characteristic of the power source is not flat, the electric energy of the power source in substantially fully utilized.

It is another object of the invention to provide a power supply in a timepiece in which, when the voltage provided by the secondary power source drops to a predetermined level, the available voltage is boosted to a higher level to drive the timepiece.

It is still another object of the invention to boost the level of voltage being supplied to the oscillator of a quartz crystal timepiece when oscillation stops.

A still further object of the invention is to provide a power supply for a solar powered timepiece which, when the voltage level of the secondary power source is below the operating level of the timepiece, insures that, upon the next illumination, the solar battery will provide a voltage level to the drive of the timepiece which is sufficient for its operation.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE INVENTION

An illustrative embodiment of the present invention is described in detail below, with reference to the accompanying drawings. The embodiment is a timepiece in which a solar battery serves as a primary power source and a high-capacity, double-layer capacitor of the electronic type is charged thereby and serves as a secondary power source.

Figure 2:
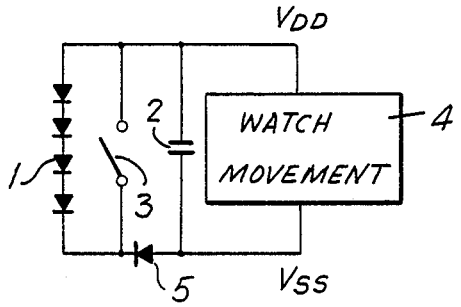
FIG. 2 PRIOR ART
FIG. 2 is a block diagram showing the structure of a known timepiece using capacitive storage.

In a known arrangement, as shown in FIG. 2, the electric power generated by a solar battery 1 is used to charge an electronic type double-layer capacitor 2 to the level at which the voltage on the capacitor equals or exceeds the nominal voltage, at which time limiter switch 3 is closed to stop the charging. Diode 5 prevents reverse flow of current from capacitor 2 into solar battery 1 when the voltage level generated by the solar battery becomes less than the voltage level present on capacitor 2. Watch movement 4 is thus driven by either solar battery 1 or capacitor 2 as the power source.

Figure 1:
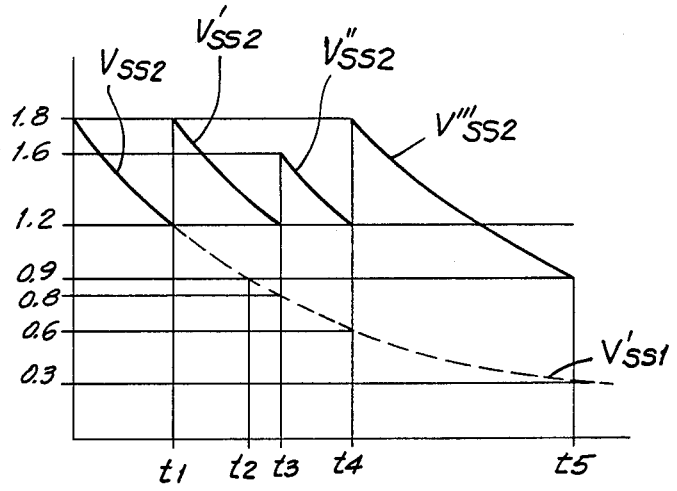
FIG. 1 is chart showing the discharge characteristic of a storage capacitor as it is operated in a variety of modes for storing electrical energy in accordance with the teachings of the invention.

As shown in FIG. 1, the discharge characteristic of capacitor 2, after illumination of solar battery 1 has ceased and with capacitor 2 fully charged to 1.8 V, is shown by solid line $V_{SS2}$ and by broken line $V'_{SS1}$. In FIG. 1, the ordinate and the abscissa are the voltage level of capacitor 2 and time, respectively. In this embodiment, the nominal voltage of capacitor 12 is 1.8 V and the watch movement stops when the voltage supplied to it falls below 0.9 V. Accordingly, the known watch stops at time t2 after illumination of solar battery 1 has ceased.

Figure 3:
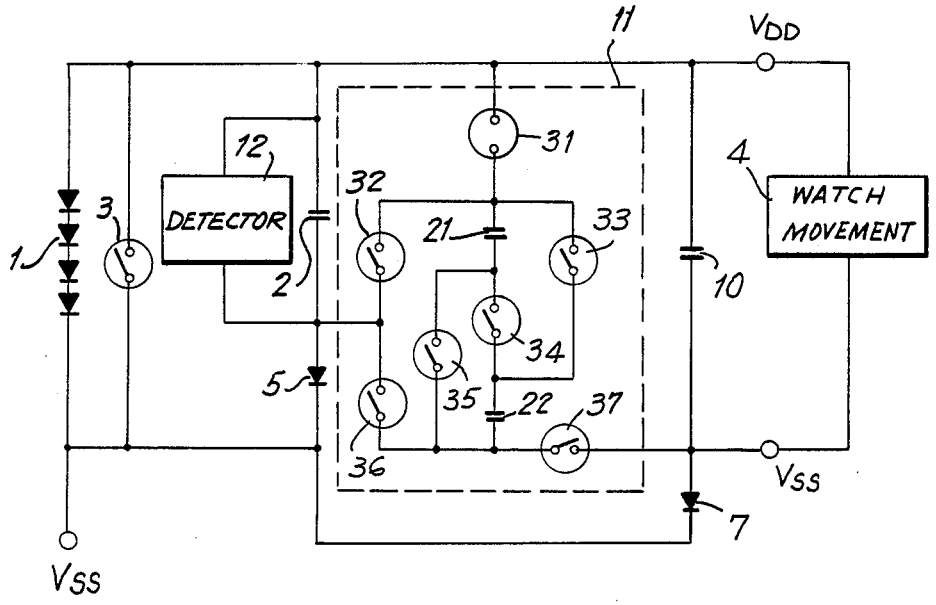
FIG. 3 is a circuit diagram showing a switching circuit for boosting and charging in accordance the teachings of the invention.

Reference is now made to FIG. 3 where a circuit of an illustrative embodiment in accordance with the teachings of this invention is depicted. The circuit of FIG. 3 is similar to the known circuit of FIG. 2 in that it includes solar battery 1 as the primary power source, limiter switch 3, watch movement 4 and diode 5. However, this circuit specifically includes a second capacitor 10 which serves as an auxiliary power source. Capacitor 10 is charged from capacitor 2 via booster and charger circuit 11 which is indicated in FIG. 3 by the dashed line. Booster and charger circuit 11 consists of capacitors 21, 22, and switches 31, 32, 33, 34, 35, 36 and 37. Power is supplied directly from capacitor 10 to watch movement 4. Detector 12 is connected across capacitor 2 for detecting the voltage on capacitor 2. A diode 7 is provided to prevent reverse flow of current from capacitor 10.

Referring to FIG. 1, the operation of this embodiment is explained as follows, beginning operation after illumination of solar battery 1 ceases, with large-capacity capacitor 2 fully charged.

When the voltage $V'_{SS2}$ of capacitor 2 is higher than 1.2 V, the switches of booster and charger 11 are set so that capacitors 2 and 10 are at the same voltage. When the voltage $V'_{SS1}$ of capacitor 2 is between 1.2 V and 0.8 V, that is, during the interval between t1 and t3 in FIG. 1, the switches of booster and charger stage 11 are operated to boost the voltage of capacitor 2 by 1.5 times and to transfer the boosted voltage to capacitor 10. Consequently, the voltage $V'_{SS2}$ of capacitor 10 is raised to between 1.8 V and 1.2 V. When the voltage $V'_{SS1}$ of capacitor 2 is between 0.8 V and 0.6 V, that is, during the interval between t3 and t4 in FIG. 1, the switches of booster and charger circuit 11 are set to raise the voltage of capacitor 2 by 2.0 times for transfer to capacitor 10, thereby putting the voltage $V''_{SS2}$ of capacitor 10 at between 1.6 V and 1.2 V. When the voltage of capacitor 2 is less than 0.6 V, namely, after t4 in FIG. 1, booster and charger 11 boosts the voltage of capacitor 2 by 3.0 times, thereby putting the voltage $V'''_{SS2}$ of capacitor 10 at between 1.8 V and 0.9 V.

Figure 5A:
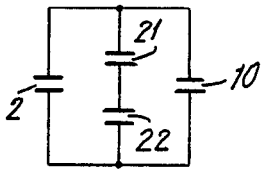
FIGS. 5A–5D are circuit diagrams illustrating the manner in which the circuits of FIGS. 3 and 4 switch the transfer capacitor connections for (a) charging and (b) boost transferring operation.
Figure 5B:
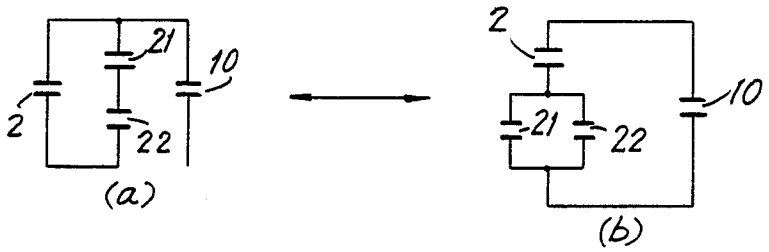
Figure 5C:
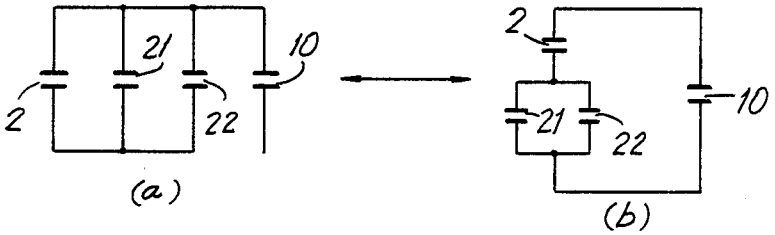
Figure 5D:
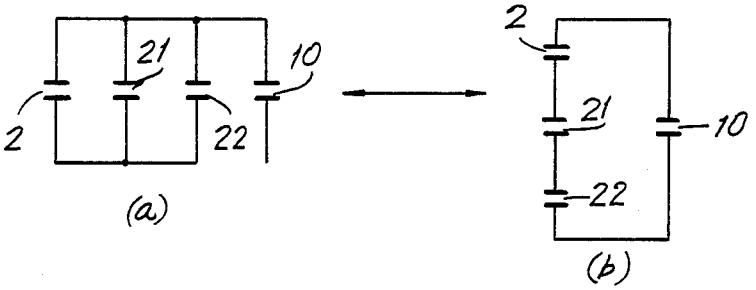

The operation of booster and charger 11 is explained with reference to FIGS. 2 and 3 as follows. To charge capacitor 10 by boosting the voltage of capacitor 2, booster and charger circuit 11 first charges capacitor 21 and 22 from capacitor 2 and then charges capacitor 10 from the sum of the voltages on capacitors 2, 21 and 22. The manner in which the capacitors are repeatedly switched in the various intervals is shown in FIG. 5, where FIG. 5(A) shows the normal connection during the time that the voltage of capacitor 2 is higher than 1.2 V (straight through mode), and FIGS. 5B(*a*) and 5B(*b*), FIGS. 5C(*a*) and 5C(*b*) and FIGS. 5D(*a*) and 5D(*b*) show the first and second connections of the transfer capacitors for 1.5 times boosting, 2.0 times boosting, and 3.0 times boosting, respectively. The switching from (a) to (b) in each of FIGS. 5A, 5B and 5C is effected by means of switches 31, 32, 33, 34, 35, 36 and 37 in FIG. 3.

As is shown in FIG. 1, by the use of the invention, the duration of watch operation is thus stretched from the conventional time t2 to the longer time t5.

Further, as compared to the known system where the useful voltage of capacitor 2 ranged from 1.8 v down to 0.9 V, by using the circuit of the invention, the useful voltage range is expanded to between 1.8 V and 0.3 V, thus making substantially full use of the energy stored in capacitor 2.

In the above-described embodiment of the invention, in addition to operation in a straight through mode, booster and charger means 11 includes three modes of boosting, e.g., by 1.5 times, 2.0 times and 3.0 times. Which mode is used depends upon the voltage which is measured by detector 12 on capacitor 2. However, this invention is not limited to the operation of the booster in the specific modes described above, but also includes the use of only one or more of the modes and of different voltage multiplying factors. Moreover, in the embodiment described above, the detector detects specific voltage levels of capacitor 2, e.g., 1.8, 1.2, 0.8, and 0.6 V. It is also within the contemplation of the invention that the detector means detects the voltage on capacitor 10, e.g., 1.8 and 1.2 V, and determines the amount of boosting needed by comparing the voltage of capacitor 10 with the setting of booster and charger 11. This method has the advantage of using a lower detection voltage.

Figure 4:
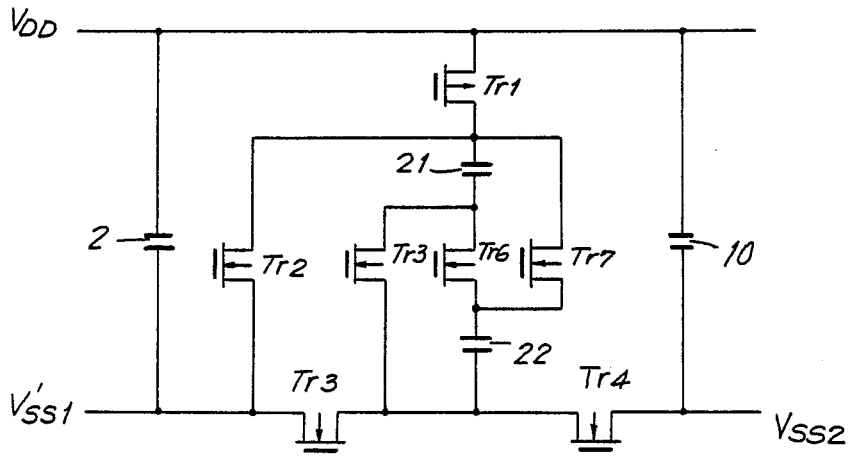
FIG. 4 is a transistorized version of the switching circuit of FIG. 3.

FIG. 4 is a diagram of the basic circuit of a transistorized multiple booster and charger stage like that of FIG. 3. In FIG. 4, capacitors 2 and 10 correspond to those in FIG. 3, capacitors 21, 22 are the transfer capacitors needed for boosting, and Tr1–Tr7 are field-effect transistors (FET) which perform the operations of switches 31–37 in voltage boosting and charge transferring. In order to level the voltage $V_{SS2}$ when boosting is not to be done, Tr3 and Tr4 are turned ON and Tr1, Tr2, Tr5, Tr6, and Tr7 are turned OFF. Herein, even if transistors Tr1, Tr5 are in the ON state, since the capacitances of capacitors 21 and 22 are small, their effect can be neglected. The state of the circuit at this time is expressed in the equivalent circuit of FIG. 5A and corresponds to operation between times t0 and t1 in FIG. 1. During the time interval t1–t3, in order to boost the voltage level by 1.5 times (hereinafter referred to a "1.5 times boost and charging") for charging the auxiliary power source, Tr1, Tr3, Tr6 are turned ON at the time of boosting, with the remaining transistors OFF; Tr4, Tr5, Tr7 are ON, with the remaining transistors OFF, at the time of transfer of charge to auxiliary power source capacitor 10. Similarly, for 2 times boost and charging during the interval t3–t4, Tr1, Tr3, Tr5 and Tr7 are turned ON at the time of boosting, with the remaining transistors OFF; the connection of the transistors at the time of charge transfer to capacitor 10 is the same as that for the transfer of 1.5 times boost and charging. For 3 times boost and charging, during the interval t4–t5, the connection of the transistors at the time of boosting is the same as that for boosting at 2 times boost and charging; to transfer the charge, transistors Tr2, Tr4 and Tr6 are turned ON, with the remaining transistors OFF, at the time of charging.

Figure 6:
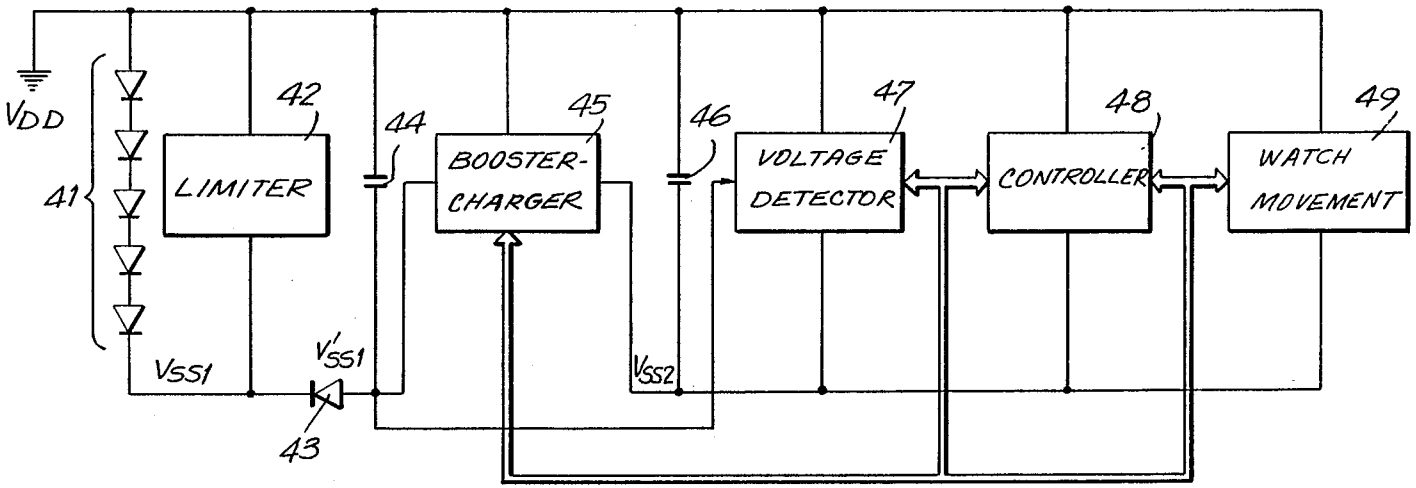
FIG. 6 is a block diagram showing the structure of a circuit for automatically effecting switching of the transfer capacitors in response to various detected voltage levels in the supply circuit.

Reference is now made to FIG. 6, which is a block diagram illustrating an electronically controlled boosting and charging system for powering a watch movement, in accordance with the invention. Here, electric power produced by illumination of solar battery 41 charges low-leakage double-layer capacitor 44 through reverse-current-preventing diode 43. When the excited voltage level $V_{SS1}$ of solar battery 41 becomes higher than the nominal voltage on capacitor 44, limiter 42 becomes effective to stop charging capacitor 44. To this end, limiter 42 consists of reference diodes which either become conductive so as to bypass the charging current when the voltage level between $V_{DD}$ and $V_{SS1}$ becomes higher than the nominal voltage of the capacitor 44 or which provide a reference level for actuating a switch (not shown) between $V_{DD}$ and $V'_{SS1}$ for bypassing the charging current which operates when a voltage level above the reference level is detected, so that $V_{SS1}$ remains at the desired level. The stored voltage in capacitor 44 may be boosted and transferred, as described above, by multiple booster and charger circuit 45. The boosted voltage is stored in the auxiliary power source capacitor 46.

The operation of this stage is as follows. In addition to powering watch movement circuit 49, capacitor 46 serves as a power supply for voltage detector 47, which detects the voltage level $V'_{SS1}$ on capacitor 44, and for controller 48, which regulates the operation of booster and charger stage 45 in response to the output signal of detector circuit 47.

Operation of this embodiment is explained in detail below, again with reference to the voltage curves of FIG. 1. In FIG. 1, the solid line and the broken line now respectively represent the absolute values of the voltage $V'_{SS1}$ of high-capacity capacitor 44 and of the voltage $V_{SS2}$ on capacitor 46, respectively.

The operation of this embodiment, after illumination of solar battery 41 has ceased and capacitor 44 is in a fully charged condition, is explained below.

When voltage $V'_{SS1}$ on capacitor 44 is 1.2 V or higher, booster and charger circuit 45 operates so as to equalize the voltages on capacitors 44 and 46. When voltage $V'_{SS1}$ on capacitor 44 is between 1.2 V and 0.8 V, that is, between times t1 and t3 in FIG. 1, booster and charger circuit 45 boosts the voltage by which capacitor 46 is charged by 1.5 times. Accordingly, voltage $V'_{SS2}$ of capacitor 46 is between 1.8 V and 1.2 V. When voltage $V_{SS1}$ of capacitor 4 is between 0.8 V and 0.6 V, that is, between times t3 and t4 in FIG. 1, booster and charger circuit 45 boosts the voltage supplied to capacitor 46 by 2 times. Accordingly, the voltage $V''_{SS2}$ is between 1.6 V and 1.2 V. When voltage $V'_{SS1}$ of capacitor 4 is less than 0.6 V, that is, at times after t4, booster and charger circuit 45 boosts the voltage fed to capacitor 46 by 3 times.

By using the booster and charger circuit of the invention as disclosed above, voltage $V_{SS2}$ of capacitor 46, which is the actual power source of the watch movement, is kept above the 0.9 V level at which the watch stops. Consequently, the duration of the operating time of the watch, as shown in FIG. 1, is expanded from t2 to t5.

Furthermore, the range of available voltage stored in capacitor 2 of the known watch of FIG. 2 has an available voltage range of 1.8 V to 0.9 V, while in accordance with the present invention, the range is increased to 1.8 V to 0.3 V. Thus the energy stored in the capacitor 4 is substantially fully utilized.

Figure 7:
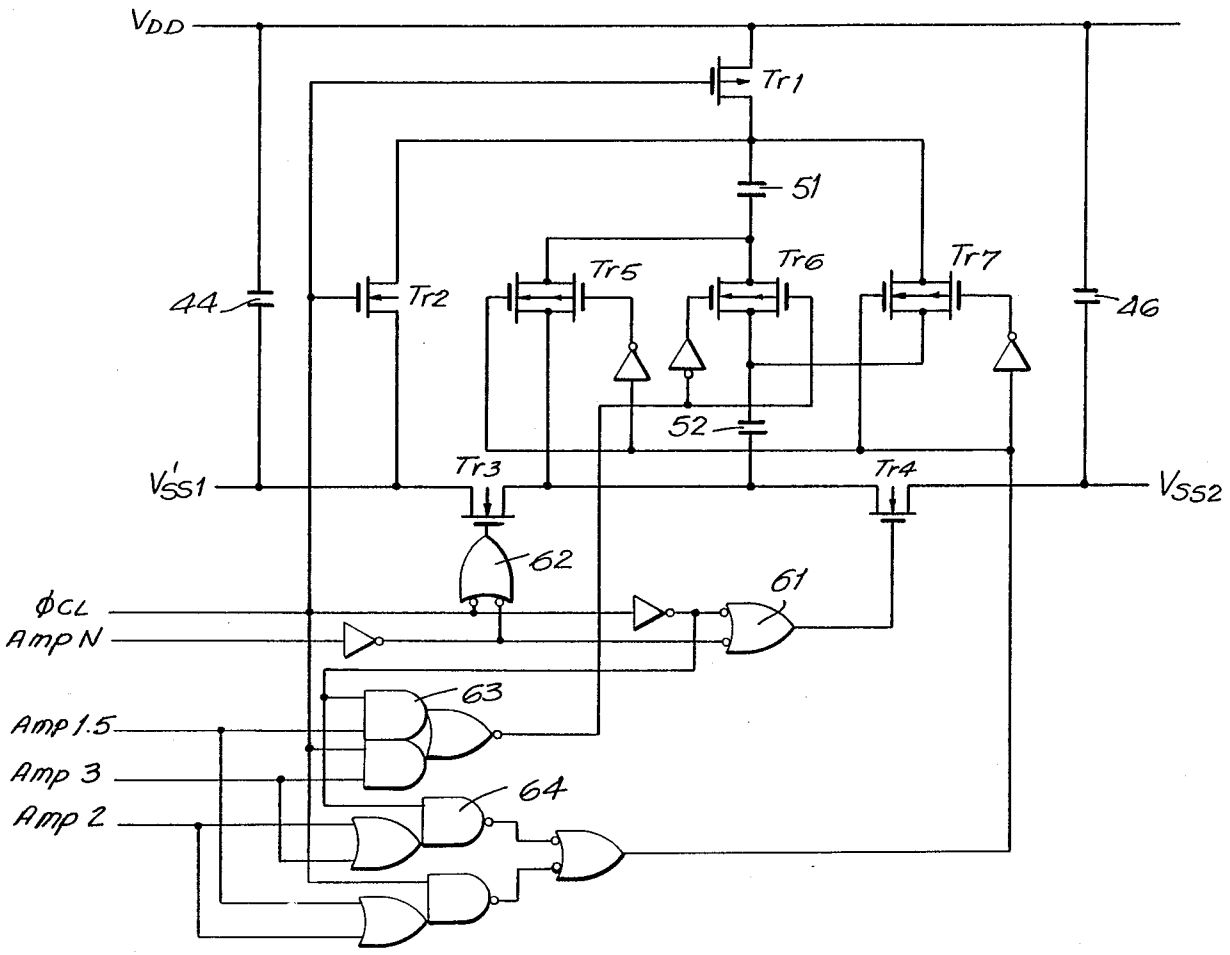
FIG. 7 is a circuit diagram showing a multiple booster circuit for use in the circuit of FIG. 6.

Detailed embodiments of multiple booster and charger circuit 46, of voltage detector 47, and of controller 48 of FIG. 6 are explained below. Reference is first made to FIG. 7 in which an electronic embodiment of the multiple booster and charger circuit 45 is depicted.

In FIG. 7, capacitors 44, 46, 51 and 52 correspond to capacitors 2, 10, 21, and 22, respectively, of FIG. 4. Transistors Tr1–Tr7 perform the same switching functions except that, to accommodate bidirectional current flow, transistors Tr5, Tr6 and Tr7 consist of the illustrated back-to-back combination of P-channel and N-channel FET's.

$\phi_{CL}$ (FIG. 7) is a clock signal which effects boosting when the logic level is low (hereinafter referred to as L) and charging when the logic level is high (hereinafter referred to as H). Thus, the circuit of FIG. 7 repeats boosting and charging operations in accordance with the frequency of boosting and charging signal $\phi_{CL}$. Amp N, Amp 1.5, Amp 2 and Amp 3 are boost control signals which specify the degree of boosting and respectively effect no boosting, boosting by 1.5 times, boosting by 2 times, and boosting by 3 times when the logic level thereof is H. Signals Amp N, Amp 1.5, Amp 2, and Amp 3 are formed by controller circuit 48 of FIGS. 6 and 9. Well-known logic gate combinations 61 and 64 control the ON and OFF states of FET's Tr1 to Tr7 to effect the charge transfer switching operations described above with reference to FIGS. 4 and 5.

Figure 8:
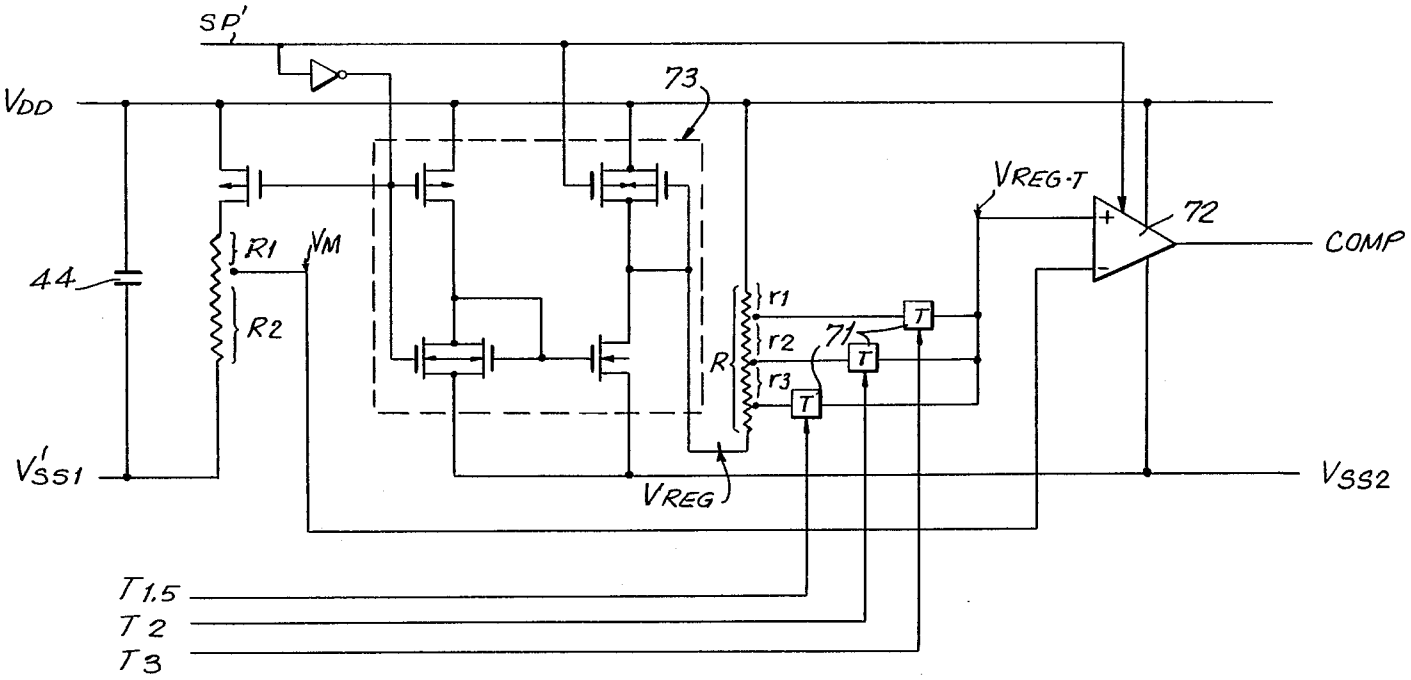
FIG. 8 is a circuit diagram showing a voltage detector circuit for use in control of the multiple booster circuit of FIG. 7.

FIG. 8 is an illustrative embodiment of voltage detector circuit 47 of FIG. 6 where sampling signal SP' controls the circuit. In response to H and L levels of sampling signal SP', the detector circuit is respectively either operative or is locked so that no current flows therethrough. The portion of the circuit which is enclosed by the broken line 73 in FIG. 7 is a reference voltage circuit of a type well-known in the art which derives a regulated voltage output $V_{REG}$ from voltage $V_{SS2}$. Input voltage divider resistors R1 and R2 are designed so that the value of $V_{REG}$, when $|V'SS1|$ is a maximum voltage of 1.8 V, satisfies the equation:

$$|V_{REG}| = |V_M| = \frac{R_1}{R_1 + R_2} |V'_{SS1}| = \frac{R_1}{R_1 + R_2} \times 1.8$$

Resistors r1, r2 and r3 are designed so that the levels of the respective tap voltages are equal to $V_M$ when $|V'_{SS1}|$ is 0.6 V, 0.8 V and 1.2 V, respectively. Of these three tap voltage levels, one level, $V_{REGT}$, is selected by one of the transmission gates 71 and compared with $V_M$ by comparator 72. Comparator 72 provides an output signal Comp at the level H when $V_M$ is lower than the selected tap voltage $V_{REGT}$, and L when $V_M$ is higher than $V_{REGT}$ and when sampling signal SP' is L. Output signal Comp is fed to controller 48 of FIGS. 6 and 9.

Control signals $T_{1.5}$, $T_2$, $T_3$ are formed by controller 48 for selecting an appropriate transmission gate 71. When control signal $T_{1.5}$, $T_2$ or $T_3$ is H, the corresponding transmission gate 71 is turned ON.

In response to the signal Comp resulting from comparison of $V_M$ with $V_{REGT}$ and in response to the state of transmission gate selecting signals $t_{1.5}$, $T_2$ and $T_3$, controller circuit 48 determines to which of the intervals between t0 and t5 of FIG. 1 the voltage level $V'_{SS1}$ belongs.

Figure 9:
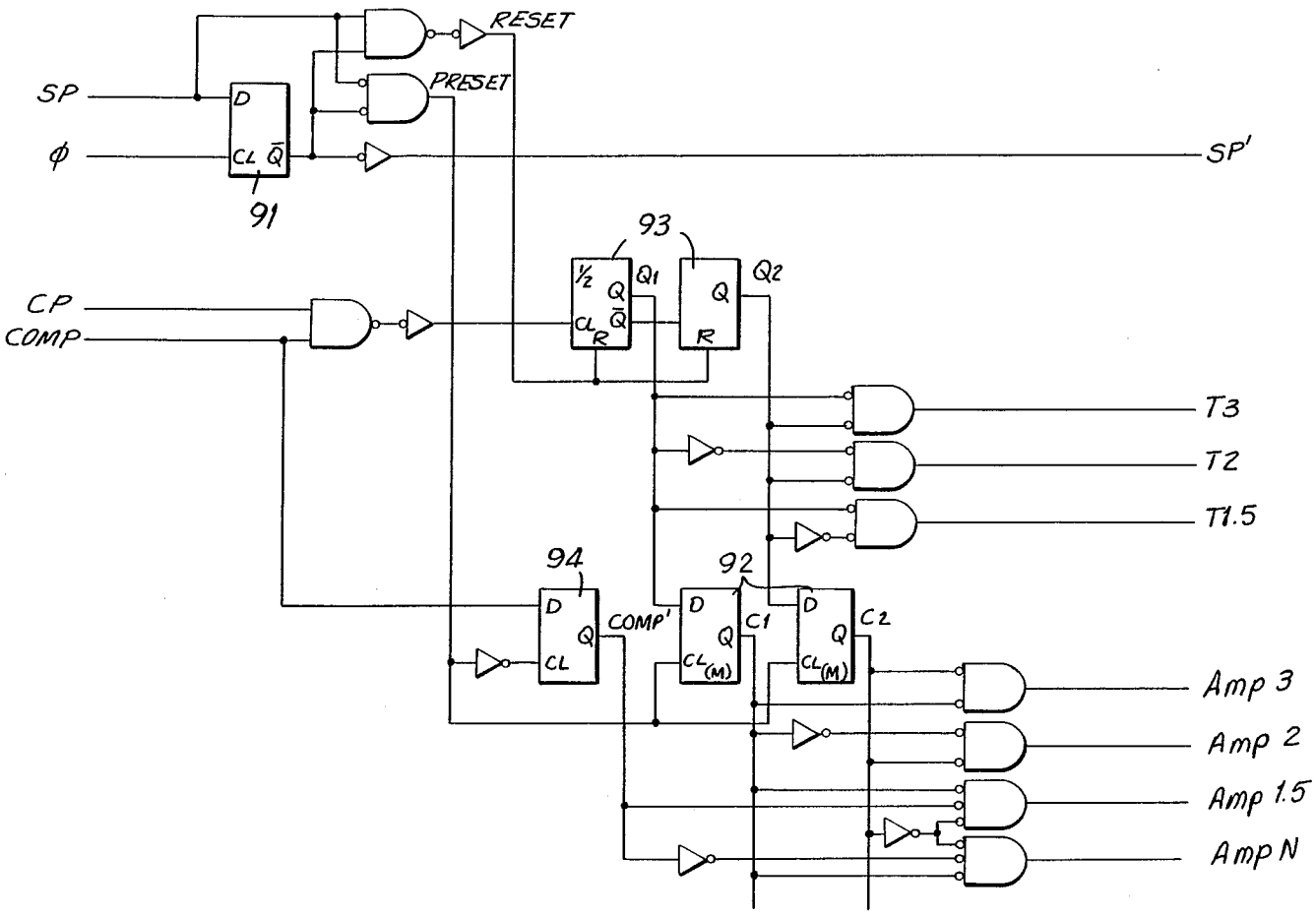
FIG. 9 is a circuit diagram showing a controller for use in controlling the booster circuit in response to signals from the detector circuit of FIG. 8.
Figure 10:
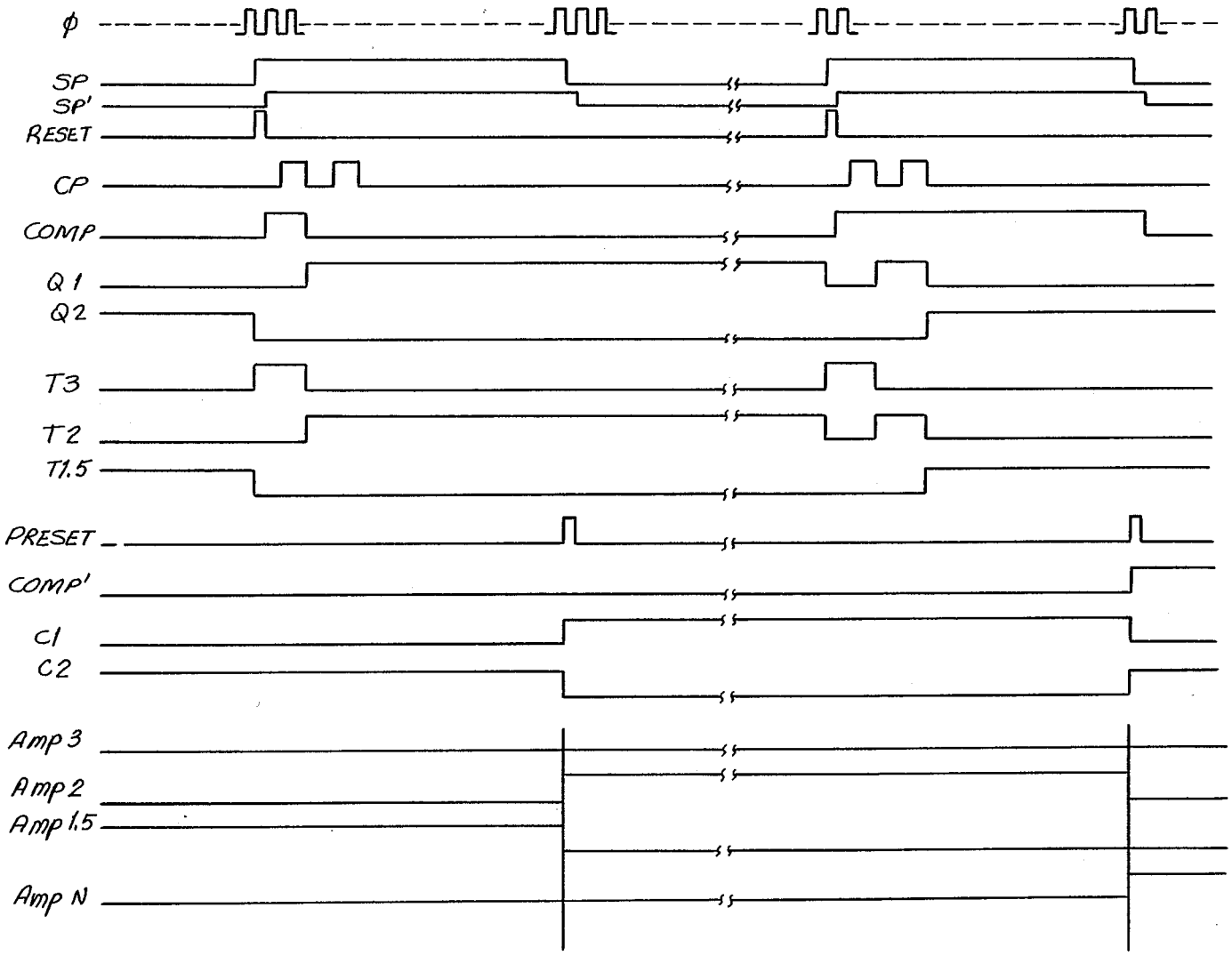
FIG. 10 is a timing chart of signals in the circuits of FIGS. 7–9.

FIGS. 9 and 10, respectively, show a detailed circuit diagram of controller 48 and a chart of the timing of the operating signals in the circuits of FIGS. 7 to 9. The left half and the right half of FIG. 10, (on either side of the interruptions in the voltage curves) respectively show the signals when the controller is switching from the 1.5 times boosting mode to the 2 times boosting mode and when the controller is switching from the 2 times boosting mode to the no boosting mode.

In FIG. 9, D-type flip-flops 91 and 94 latch data in response to the rise of signals on input terminals CL, flip-flops 92 define a master latch which holds data in response to the L state of an input signal on inputs CL, and flip-flops 93 define a 2-bit binary counter; the remaining elements are various well-known gates which combine the input signals to produce the needed control signals.

The operation of the controller of FIG. 9 is explained first with reference to the left half of the timing chart of FIG. 10. Before sampling signal SP goes H, the boosting amplification signal currently being fed to FIG. 7 is Amp 1.5 and, of the transmission gate selecting signals, control signal $T_{1.5}$ is H. These conditions are stored in master latch 92 and binary counter 93, respectively. Herein, when sampling signal SP is provided, the Reset signal is provided simultaneously, whereby conditions return to the initial state in which the transmission gate selecting signal $T_3$ is H. Then, in response to the signal CP, one of the transmission gate selecting signals $T_3$, $T_2$ or $T_{1.5}$ is selected and remains selected until output Comp from comparator 72 in FIG. 7 becomes L.

When voltage level $|V'_{SS1}|$ of main storage capacitor 44 is in the range from 0.8 V to 0.6 V (i.e., in the interval t3 to t4 in FIG. 1), as is apparent from the description of FIG. 8, the voltage levels of $V_M$ and $V_{REGT}$ are reversed in response to the H state of gate selecting signal $T_2$. Comp goes L, thus detecting the range of the voltage level of $V_{SS1}$. Since the detecting voltage for gate signal of $T_3$ is 0.6 V and that for gate signal $T_2$ is 0.8 V, when the output of the comparator is reversed so as to fall between these voltages, the voltage level of $V'_{SS1}$ is found to be in the range from 0.6 V to 0.8 V.

When $|V'_{SS1}|$ is 1.2 V or higher, gate signal $T_{1.5}$ is H and Comp is also H.

After Comp goes L, signal CP is inhibited and the state of the transmission gate selecting signal is stored in binary counter 93.

Accordingly, depending on the content of binary counter 93 after the signal CP is inhibited, and on the state of Comp, the appropriate boosting amplification is determined by D-type flip-flop 94, master latch 92 and the associated gates, which operate when sampling signal SP falls.

As thus explained, in accordance with the illustrative embodiment of the invention, the duration of the operating time of the timepiece is expanded from time t2 to time t5 of FIG. 1.

Furthermore, with respect to the voltage on capacitor 44, the range of voltage made available therefrom in the prior art is 1.8 V to 0.9 V, while that made available in the illustrative embodiment of this invention is 1.8 V to 0.3 V. Thus, the energy stored in capacitor 4 is substantially fully utilized.

In the foregoing illustrative embodiments of the invention, boosts by 1.5 times, 2.0 times and 3.0 times are provided by the multiple booster and charger circuit in the embodiment of FIGS. 6–10 and the proper one is selected in accordance with the signal output by voltage detector circuit 47 as explained before. In the present invention, however, the booster means used are not limited to the above three modes; the use of a single boost and the use of more than three boosts are also within the scope of the invention.

Moreover, though the voltages 1.8, 1.2, 0.8 and 0.6 V on capacitor 44 are detected in the embodiment of FIG. 6, it is also possible to detect the voltage on capacitor 46 (1.8 V, 1.2 V) and by comparing the detected voltage with the setting of multiple booster and charger circuit 45, to determine the needed boosting amplification. The latter method has the advantage that the voltage detection is accomplished at a low voltage.

Further, it is to be understood that primary power source 41 is not limited to solar batteries, but may be one of many well-known generators of electric energy. Further, generator 41 and limiter 42 can be combined in one. Even when an ordinary battery is used, the full effect of this invention may be fully enjoyed.

Referring again to FIG. 1, when $V'_{SS1}$ is between 0.3 V and 0 V, the oscillator circuit in the driver system of the watch movement stops oscillation and the watch stops. When oscillation ceases, the clock signal used for boosting is not delivered and, accordingly, the booster is not actuated. In this condition, if solar battery 1 of the watch were connected to charge a storage capacitor, the electric current generated by illumination of the solar battery would serve only to charge the capacitor circuit and the rise in voltage would be very slow. Consequently, the oscillator cannot immediately begin to oscillate and actuation of the booster circuit will be delayed for some time, with the result that considerable time will be required for starting operation of the watch movement.

To solve this problem, according to the present invention, the power circuit of the watch is designed so that, when the oscillator stops oscillating, the solar batter is directly connected to the oscillator circuit and the solar battery is disconnected from the charger circuit, including the booster. A circuit which accomplishes this purpose is shown in FIG. 11.

Figure 11:
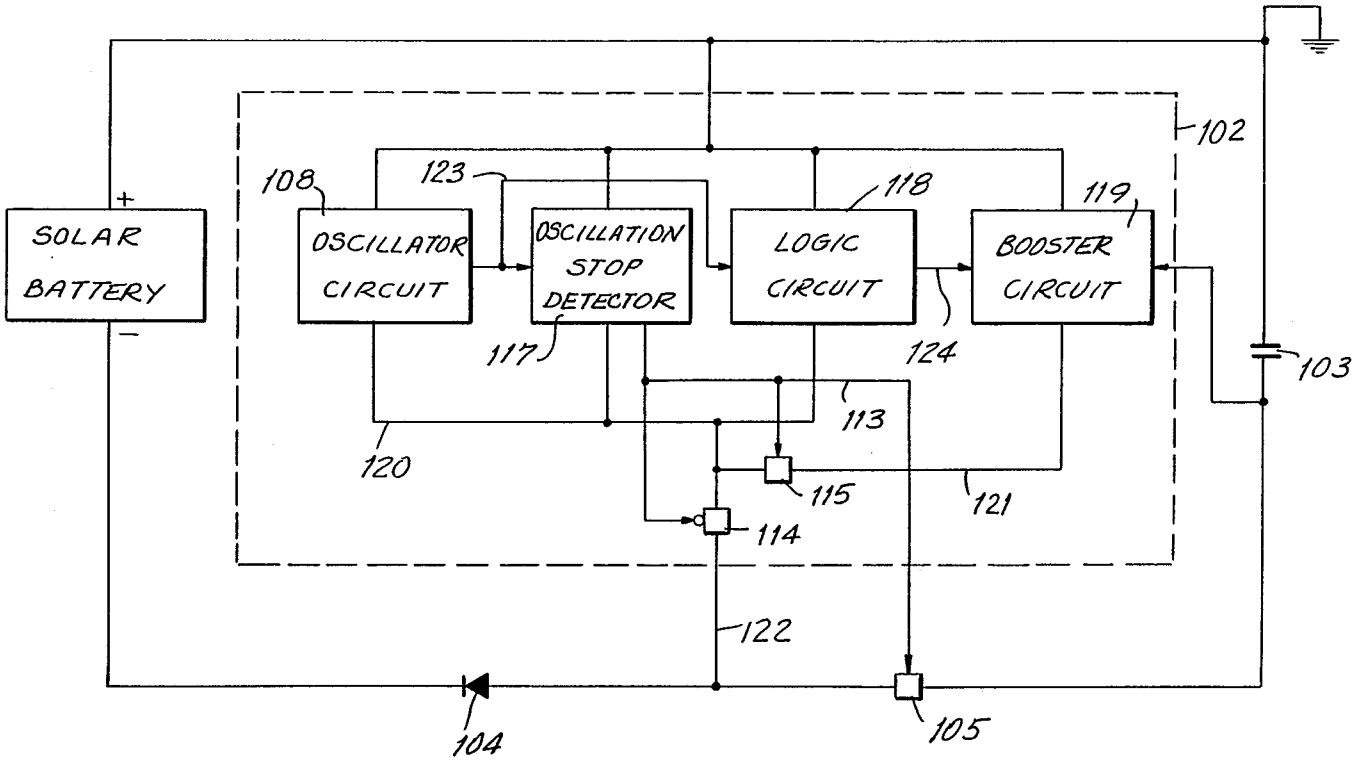
FIG. 11 is a block diagram of a circuit for detecting failure of oscillation in a timepiece to initiate boosting of the voltage supplied to the oscillator.

In the circuit of FIG. 11, watch movement driver 102 is enclosed by the broken line; the limiter of the previous embodiments is omitted, and multiple booster 45, voltage detector 47, and controller 48 of FIG. 6 are replaced by booster 119 and logic 118 so as to simplify explanation of the invention.

Given that auxiliary power source (capacitor) 103 is in a low voltage condition, that is 0.3 V or less, and that oscillator 108 does not deliver an oscillation signal on line 122, oscillation stop detector 117 outputs an L state control signal on gate control line 113 which turns gate 114 ON and gates 105 and 115 OFF. As a result, oscillator 108 is disconnected by gate 115 from power supply output line 121 of booster circuit 119, and is connected instead by gate 114 to power supply line 122 from diode 104 and solar battery 101.

When illumination of solar battery 101 produces enough voltage to start oscillator 108, the start of oscillation is detected by oscillation stop detector 117, and logic circuit 118, which is connected thereto, generates a clock signal 124 on line 124 for boosting. Booster 119 begins boosting voltage from solar battery 101 for transfer to power source 103 and secondary source 103 acquires the boosted voltage. As oscillation continues, transmission gate 114 turns OFF and transmission gates 115 and 105 turn ON, and oscillator 108 is again powered from booster 119. Thus, watch movement driver 102 is now driven by the boosted voltage in auxiliary power source 103 which is again being charged from solar battery 101.

As explained above, even if the voltage in auxiliary source 103 is low, the watch is immediately started into operation by the circuit of FIG. 11.

Figure 12:
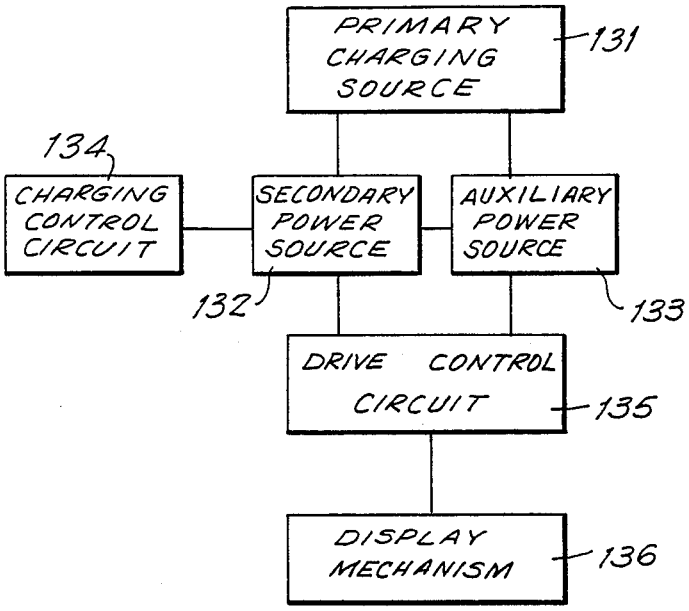
FIG. 12 is a block diagram of a circuit for controlling the charging of secondary and auxiliary power sources for driving a watch mechanism.

Reference is now made to FIG. 12 which is a functional block diagram illustrating another embodiment of the invention. Here, primary source 131 supplies charge to a secondary power source 132 and to an auxiliary power source 133. Primary source 131 may be a voltage generator, such as a solar battery, or another form of commercially available battery which is capable of changing both secondary power source 132 and auxiliary power source 133. Secondary power source 132 has more energy storage capacity than auxiliary power source 133. Direct charging of secondary power source 132 and auxiliary power source 133 is controlled by a charging control circuit 134. When primary charging source 131 is not active, and when the level of voltage on secondary power source 132 is insufficient to activate the drive control circuit 135, drive control circuit 135 can draw upon the energy stored in auxiliary power source 133 for the required power. In this illustrative embodiment, drive control circuit 135 supplies time related signals for driving the display mechanism 136 of an electronic timepiece.

Figure 13:
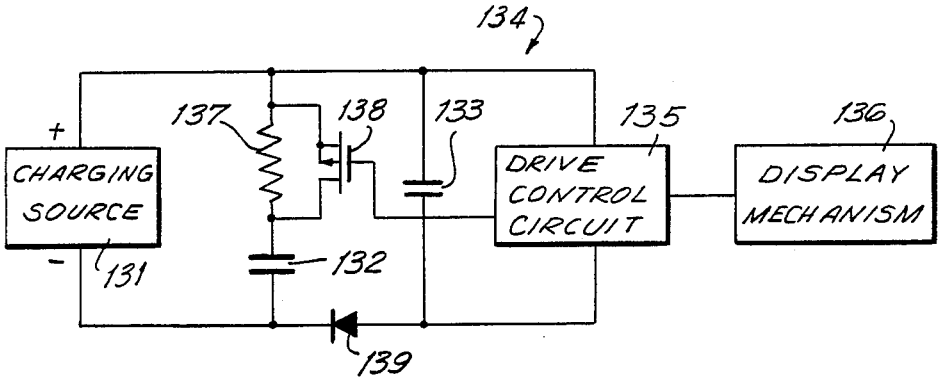
FIG. 13 is a diagram showing details of the charging control circuit of FIG. 12.

In FIG. 13, which is based on the block diagram of FIG. 12 and which shows details of charge control circuit 134 of FIG. 12, like parts bear the same numbers as those in FIG. 12. In FIG. 13, a voltage dropping element 137 is connected in series with the secondary power source 132, the combination being connected across primary charging source 131. Voltage dropping element 137 may be a resistance, as shown, or it may be a diode or other device known in the art which produces a voltage drop when charging current is flowing to secondary power source 132. A switching transistor 138 is connected across voltage dropping element 137 and responds to a signal from drive control circuit 135 to short out the element 137 so that power flows directly to secondary power source 132. Diode 139 prevents the flow of current in the reverse direction from auxiliary power source 133 to the first secondary power source 132. Secondary power source 132 is a large-capacity, double-layer capacitor. Auxiliary power source 133 is a tantalum electrolytic capacitor of lesser capacitance than the double-layer capacitor.

In operation, when the voltage level of secondary power source 132 is zero, switching transistor 138 is turned OFF. When solar battery charging source 131 is illuminated, current flows therefrom in two loops. In one loop, current flows from the positive side of primary source 131, through dropping resistor 137 and secondary power source 132, to the negative side of primary charging source 131. In the second loop, current flows from the positive side of primary source 131, through the auxiliary power source 133 and diode 139 to the negative side of primary source 131. Thus, both the secondary and the auxiliary power sources are charged at the same time. Due to the flow of charging current, the voltage level on auxiliary power source 133 becomes higher than that on secondary power source 132 by an amount which is equal to the voltage drop occurring across series resistance 137 less the voltage drop appearing across diode 139 due to its internal resistance. The voltage level at auxiliary power source 133 is therefore always lower than the voltage across dropping resistance 137, and the auxiliary power source is protected against the inadvertent application of excessive voltage when solar battery charging source 131 is suddenly illuminated, avoiding damage or destruction. By proper choice of resistance value for dropping resistor 137, a potential difference which is sufficient to operate drive control circuit 135 can be provided in spite of the presence of a low or zero voltage on secondary power source 132.

Should the flow of current from solar battery charging source 131 be interrupted, diode 139 prevents the draining of charge stored in auxiliary power source 133 to secondary power source 132. When the voltage on secondary power source 132 has attained a level which is sufficiently high to operate driving control circuit 135, switching transistor 138 is turned on by a signal from the drive control circuit and dropping resistor 137 is shorted out, thereby enhancing the efficiency of charging of secondary power source 132.

Thus, the embodiment of FIG. 12, by means of a very simple circuit, speeds stable operation of drive control circuit 135 from auxiliary power source 133 after a small amount of power has been supplied, even when the initial voltage on secondary power source 132 is zero.

Figure 14:
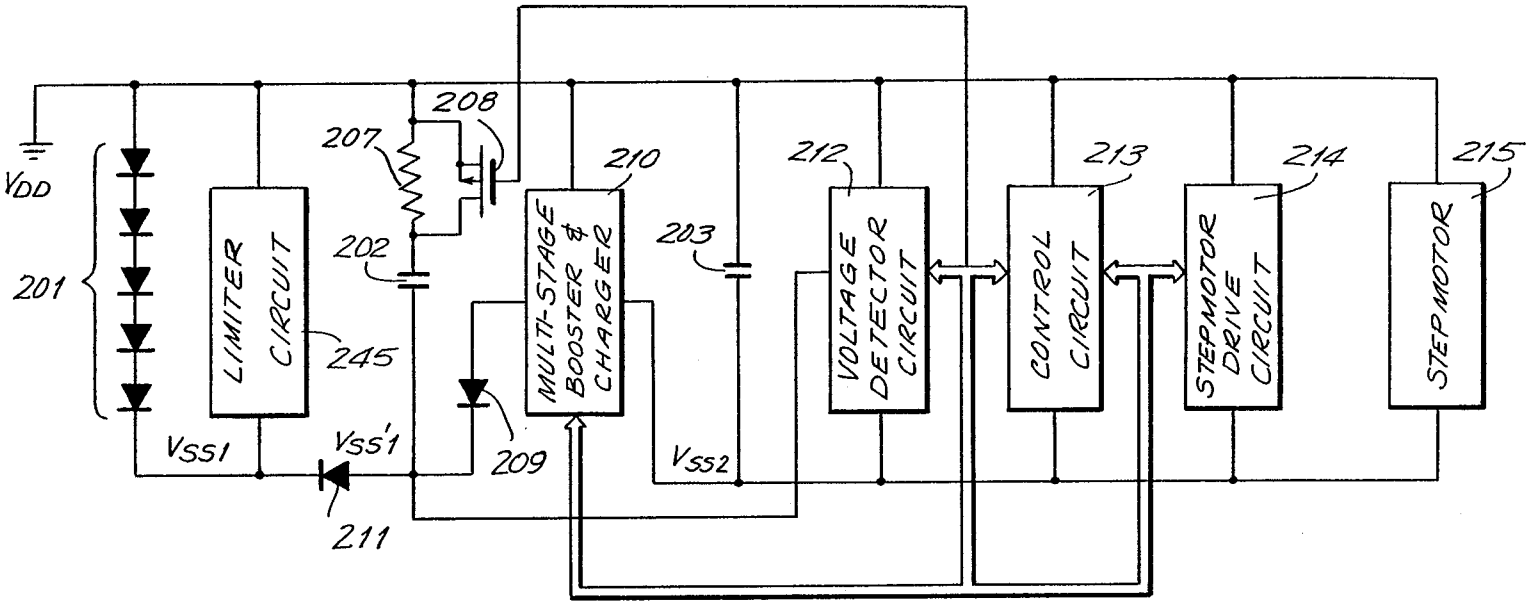
FIG. 14 is a block diagram similar to that of FIG. 6 but including the charging control circuits of FIGS. 13 and 14.
Figure 15:
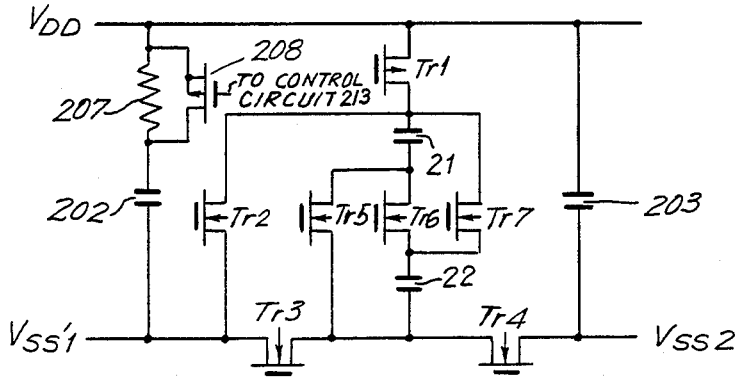
FIG. 15 is a diagram showing details of the multistage booster and charger circuit of FIG. 14.

FIG. 14 is a block diagram of an embodiment of the invention in which the system of FIG. 13 is combined with the booster circuit of FIG. 6. In this embodiment, solar battery 201 is the primary power source and there are a secondary power source 202, an auxiliary power source 203, a dropping resistor 207, a switching transistor 208, diodes 209 and 211 for preventing reverse current flow, a booster charger 210, a voltage detector 212, a control circuit 213, a step motor drive circuit 214, a step motor 215, and a limiter circuit 245. Resistance 207, switching transistor 208 and diode 209 correspond in structure and function to resistance 137, switching transistor 138 and diode 139 of FIG. 13. Also, capacitors 202 and 203 correspond to capacitors 132 and 133 of FIG. 13. Since, except for the inclusion of the elements of a charge control circuit and the expansion of watch movement 49 into step motor elements 214 and 215, the functions of the blocks have been explained above in connection with FIG. 6, the manner of operation of each block in FIG. 14 is not described here. However, the operation of booster and charger 210 of FIG. 14 will be described with reference to FIG. 15 where details of that circuit, along with relevant portions of the circuit of FIG. 14, are shown. In FIG. 15, the connections between secondary power source capacitor 202, auxiliary power source capacitor 203, and transfer capacitors 221 and 222 are switched by field-effect transistors Tr1–Tr7 in the same way as previously described. However, operation of the circuit of FIG. 15 differs from that of FIG. 4 in that, in order to make the voltages $V_{SS'1}$ and $V_{SS2}$ equal without boosting when starting up, transistors Tr3 and Tr4 are turned ON with the remaining transistors turned OFF.

The embodiments of FIGS. 12–15 thus provide circuits which are useful, for example, with electric timepieces in which intermittently available energy is used to store charge in a storage device which can power a timepiece when operation of the source of external energy is stopped. It will be apparent to those skilled in the art that, alternatively to the control signal from drive control circuit 135, the operation of transistor 137 (FIG. 13) or 207 (FIG. 14) can be controlled by a signal from a voltage level detector which functions separately of the illustrated drive control or voltage detector circuits at start-up. Alternatively, the output of oscillation stop detector 117 of FIG. 11 can be used, being for example, ANDed with the signal from a voltage detector in a circuit in which the function of FIGS. 11 and 14 are combined. By this arrangement, the control signal is altered when oscillation stops or when the voltage supplied by the primary source drops.

It is to be understood that, even though the solar battery is used as the primary power source in the above examples, other types of generator may be substituted therefor, with the same results.

As described hereinbefore, in accordance with the present invention the loss of electric energy is minimized in an electronic timepiece having a primary power source whose discharge characteristic has a large fluctuation of output voltage. In other words, the electric energy of the power source is fully utilized. Accordingly, by using a capacitor in the power supply of a solar battery timepiece, the operating time of the timepiece between chargings is considerably lengthened and battery changes are not required. In timepieces which use batteries such as alkali-manganese batteries or lithium batteries, substantial energy savings are realized, resulting in reduced frequency of battery replacement.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

What is claimed is:

1. An electronic timepiece comprising:

a primary source of electric power;

a secondary power source which is charged by the primary source and whih has an output voltage which changes with use of power stored therein;

a timepiece movement; and a supply circuit which delivers power from the secondary power source to the timepiece movement, the supply circuit comprising:

detector means responsive to the level of the output voltage of the secondary power source to provide a control signal when the output voltage has fallen to a predetermined voltage level;

booster means in the supply circuit, the booster means being responsive to the control signal for transforming voltage from the secondary power source to a higher level for delivery to the timepiece movement;

an auxiliary power source which is charged by the booster means above the predetermined voltage level and which delivers the charge to the timepiece movement; and whereby the level of voltage supplied to the timepiece movement from the secondary power source is maintained above the predetermined level.

2. An electronic timepiece in accordance with claim 1 in which the auxiliary storage means comprises an auxiliary storage capacitor.

3. An electronic timepiece in accordance with claim 1, wherein the means for transforming voltage to a different level further comprises:

at least one transfer capacitor; and switch means responsive to the control signal for first coupling the transfer capacitor in parallel with the secondary power source to be charged and then in series with the secondary power source to deliver energy to the auxiliary storage means, whereby the charge delivered from the secondary power source to the auxiliary storage means is boosted by the charge stored in the transfer capacitor and the voltage level of the auxiliary storage means is raised above the level of the secondary power source.

4. An electronic timepiece in accordance with claim 1, wherein the means for transforming voltage to a different level further comprises:

at least two transfer capacitors; and switch means responsive to the control signal to first couple the transfer capacitors in series with each other to be charged from the secondary power source and then to couple the capacitors in parallel with each other and in series with the secondary power source to charge the auxiliary storage means.

5. An electronic timepiece in accordance with claim 1, wherein the means for transforming voltage to a different level further comprises:

at least two transfer capacitors; and switch means responsive to the control signal to first couple the transfer capacitors in parallel with each other and with the secondary power source to be charged and then to couple the transfer capacitors in parallel with each other and in series with the secondary power source to charge the auxiliary storage means.

6. An electronic timepiece in accordance with claim 1, wherein the means for transforming the voltage to a different level further comprises:

at least two transfer capacitors; and switch means responsive to the control signal to first couple the transfer capacitors in parallel with each other to be charged from the secondary power source and then to couple the transfer capacitors in series with each other and with the secondary power source to charge the auxiliary storage means.

7. An electronic timepiece in accordance with claim 1, wherein the detector means provides at least first and second control signals in response to the detection of first and second predetermined voltage levels in the supply circuit, and wherein the means for transforming voltage to a different level further comprises:

at least two transfer capacitors; and switch means responsive to the first control signal to first couple the transfer capacitors in series with each other to be charged from the secondary power source and then to couple the transfer capacitors in parallel with each other and in series with the secondary storage means to charge the auxiliary storage means, and the switch means responsive to the second control signal to first couple the transfer capacitors in parallel with each other to be charged from the secondary power source and to then couple the transfer capacitors in parallel with each other and in series with the secondary power source to charge the auxiliary storage means.

8. An electronic timepiece in accordance with claim 7, wherein the detector means provides a third control signal in response to detection of a third predetermined voltage level in the supply circuit, and wherein the switch means responds to the third control signal to first couple the transfer capacitors in parallel with each other and with the secondary power source to be charged and then to couple the transfer capacitors in series with each other and with the secondary power source to charge the auxiliary storage means.

9. An electronic timepiece in accordance with claim 1, wherein the detector means provides first and second control signals in response to detection of predetermined first and second voltage levels, respectively, in the supply circuit and wherein the means for transforming voltage to a different level further comprises:

at least two storage capacitors; and switch means responsive to the first control signal to first couple the transfer capacitors in parallel with each other to be charged from the secondary power source and then to couple the transfer capacitors in parallel with each other and with the secondary power source to charge the auxiliary storage means, and the switch means responsive to the second control signal to first couple the transfer capacitors in parallel with each other and with the secondary power source to be charged and then to couple the transfer capacitors in series with each other and with the secondary power source to charge the auxiliary storage means.

10. An electronic timepiece in accordance with claim 3, wherein the switch means comprises a plurality of switching transistors.

11. An electronic timepiece in accordance with claim 1, wherein the detector means further comprises:

means having a reference voltage level as an output; and means for comparing the voltage level at the predetermined point in the supply circuit with the reference voltage level to provide the control signal when the predetermined voltage level is present.

12. An electronic timepiece in accordance with claim 11, and further comprising:

logic means responsive to the comparison signal for controlling the transforming means.

13. An electronic timepiece in accordance with claim 7, wherein the detector means further comprises:

means having at least first and second reference voltage levels as outputs; and means for comparing the voltage level at the predetermined point in the supply circuit with the first and second reference voltage levels to provide one of the first and the second control signals for initiating a respective voltage transformation when one of the first and the second predetermined voltage level is present.

14. An electronic timepiece in accordance with claim 13, wherein a third reference voltage level is provided for comparison with the voltage level at the predetermined point to provide a third control signal for initiating a third voltage transformation when a voltage having a third predetermined level is present.

15. An electronic timepiece in accordance with claim 3, and further comprising:

control means coupled to the detector means for cyclically actuating the detector to determine the voltage level at the predetermined point in the supply circuit, whereby the voltage level of the auxiliary storage means is repeatedly boosted.

16. An electronic timepiece in accordance with claim 1, wherein the watch movement further comprises an oscillator which is powered by the supply circuit, and further comprising:

detector means coupled to the output of the oscillator for providing a failure signal in the event that oscillation stops; and switch means responsive to the failure signal to disconnect the oscillator from the supply circuit and to connect it to the secondary power source to reestablish oscillation.

17. The electronic timepiece of claim 16, wherein when oscillation is reestablished, the switch means reconnects the oscillator to the supply circuit.

18. An electronic timepiece in accordance with claim 1, wherein the secondary power source is a storage capacitor.

19. The electronic timepiece of claim 1 and further comprising:

coupling means for coupling the primary source to the secondary power source and for providing, when the primary source begins operating and when insufficient energy is stored in the secondary power source to provide the minimum operating voltage to the timepiece movement, a voltage from the primary source for supply to the timepiece movement which rises quickly above the minimum operating voltage prior to the time that the voltage on the secondary power source rises to the minimum operating level.

20. The electronic timepiece of claim 19, wherein the coupling means limits current flow to the secondary power source until the voltage level of the secondary power source reaches at least the minimum operating voltage.

21. The electronic timepiece of claim 20, wherein the coupling means includes switch means responsive to a control signal for connecting the secondary power source directly to the primary source when the voltage level of the secondary power source is at least at the minimum operating voltage.

22. The electronic timepiece of claim 21 wherein the coupling means comprises a resistor and the switch means comprises a transistor connected in parallel with the resistor.

23. The electric timepiece of claim 21:

wherein the auxiliary storage means is of lesser capacity than the secondary power source.

24. The electronic timepiece of claim 23 wherein the primary source comprises a solar battery, the secondary power source comprises a double-layer capacitor, and the auxiliary storage means comprises a tantalum electrolytic capacitor.

25. The electronic timepiece of claim 23 and further comprising:

detector means for generating the control signal when the voltage on the secondary power source has reached a predetermined level.

26. The electronic timepiece of claim 23 and further comprises:

means coupled to the timepiece movement for providing the control signal when the timepiece movement is operative.

27. The electronic timepiece of claim 19 wherein the primary source comprises a solary battery.

28. The electronic timepiece of claim 1, wherein when the detector means detects the voltage level of the secondary power source falling below a second predetermined level, the booster means maintains the voltage level supplied to the timepiece above the first predetermined level and when the detector means detects the voltage level of the secondary power source falling below a third predetermined voltage level the booster means maintains the voltage level supplied to the timepiece above the first predetermined level, wherein the first predetermined voltage level is greater than the second predetermined voltage level and the second predetermined voltage level is greater than the third predetermined voltage level.

29. The electronic timepiece of claim 9, wherein when the detector means detects the voltage level of the secondary power source falling below a second predetermined level the booster means maintains the voltage level supplied to the timepiece above the first predetermined level and when the detector means detects the voltage level of the secondary power source falling below a third predetermined voltage level the booster means maintains the voltage level supplied to the timepiece above the first predetermined level, wherein the first predetermined voltage level is greater than the second predetermined voltage level and the second predetermined voltage level is greater than the third predetermined voltage level.

30. An electronic timepiece comprising:

means for converting externally supplied energy into electricity;

timekeeping means having a minimum operating voltage;

first storage means for coupling the converting means to the timekeeping means, the first storage means receiving and storing electricity from the converting means and delivering stored electricity to operate the timekeeping means;

auxiliary storage means, having a capacity less than the capacity of the first storage means, said auxiliary storage means being charged by the converting means and the first storage means and delivering power to the timekeeping means;

a reverse current prevent element coupled between the auxiliary storage means and the first storage means;

a high impedance element coupled between the converting means and the first storage means; and coupling means for coupling the converting means to the auxiliary storage means when the voltage being supplied to the timekeeping means by the first storage means is below the minimum operating voltage, so that, when the voltage level of the first storage means is less than the minimum operating voltage, a greater amount of current supplied by the converting means flows to the auxiliary storage means than to the first storage means.

31. The electronic timepiece of claim 30 wherein the coupling means limits current flow to the storage means until the voltage level of the storage means reaches at least the minimum operating voltage.

32. The electronic timepiece of claim 31, wherein the coupling means includes switch means responsive to a control signal for connecting the storage means directly to the converter means when the voltage level of the storage means is at least the minimum operating voltage.

33. The electronic timepiece of claim 32 wherein the coupling means comprises a resistor and the switch means comprises a transistor connected in parallel with the resistor.

34. The electronic timepiece of claim 32 wherein the converting means comprises a solar battery, the storage means comprises a double-layer capacitor, and the auxiliary storage means comprises a tantalum electrolytic capacitor.

35. The electronic timepiece of claim 32 and further comprising:

detector means for generating the control signal when the voltage on the storage means has reached a predetermined level.

36. The electronic timepiece of claim 32 and further comprising:

means coupled to the timekeeping circuit for providing the control signal when the timekeeping means is operative.

37. The electronic timepiece of claim 32 and further comprising:

means coupled between the storage means and the auxiliary storage means and responsive to a control signal for transforming voltage from the storage means to a different level for delivery by the auxiliary storage means to the timekeeping means.

38. The electronic timepiece of claim 30 wherein the converting means comprises a solar battery.

* * * * *